United States Patent [19]

Lundin et al.

[11] 4,173,795

[45] Nov. 13, 1979

[54] RACQUETBALL OR SQUASH SAFETY MASK

[76] Inventors: Alyce Lundin, 11235 Constellation Dr.; Robert V. Bravin, 1576 Wagner Dr., both of El Cajon, Calif. 92020

[21] Appl. No.: 928,374

[22] Filed: Jul. 27, 1978

[51] Int. Cl.[2] ..... A42B 1/08; A63B 71/10

[52] U.S. Cl. ..... 2/425; 2/9

[58] Field of Search ..... 2/9, 424, 425, 410

[56] References Cited

U.S. PATENT DOCUMENTS

| | | | |
|---|---|---|---|
| 552,557 | 1/1896 | Weber | 2/9 |
| 933,342 | 9/1909 | Rix | 2/9 |
| 1,016,029 | 1/1912 | O'Shea | 2/9 |
| 1,203,564 | 11/1916 | April | 2/9 |

*Primary Examiner*—Louis Rimrodt

*Attorney, Agent, or Firm*—Charles C. Logan, II

[57] ABSTRACT

A racquetball or squash safety mask having a primary framework assembly, a secondary framework assembly, a grid network covering the secondary framework assembly, and a head strap assembly. The primary framework assembly has a top framework member, a bottom framework member, and a pair of side framework members that function to form a base for the secondary framework assembly and also to support the safety mask upon the wearer's face. The secondary framework assembly is attached to the primary framework assembly and it forms a convex frame having a central vertical strut member and a pair of intermediate strut members all of which extend between the top and bottom framework members. A pair of cross members link the central strut member to the intermediate strut members and the intermediate strut members in turn to the side framework members. The primary framework assembly and the secondary framework assembly are made from light weight metallic rod members that are coated with a high impact plastic material. A grid network covers the secondary framework assembly and it comprises a plurality of wire filaments that are coated with a high impact plastic and which criss-cross each other with their ends secured to the primary framework assembly. The filaments of the grid network are laterally spaced apart a distance greater than one inch but less than two inches. The filaments are also diagonally oriented with respect to the front of the mask such that none of the filaments lie in a vertical plane thereby minimizing the amount of impairment of the wearer's vision. A temple guard member extends rearwardly from each of the side framework members.

7 Claims, 3 Drawing Figures

RACQUETBALL OR SQUASH SAFETY MASK

BACKGROUND OF THE INVENTION

The invention relates to a safety mask and more specifically to a safety mask for playing racquetball or squash.

In the past safety masks have been used in different sports. One familiar example is the catcher's mask that is used in baseball. It has a fairly heavy frame with a plurality of vertical and horizontal cross members that intersect each other and which are laterally spaced by a distance less than the diameter of a baseball. These cross members are relatively thick and relatively heavy due to the necessity of being able to stop a baseball traveling at speeds up to 100 mph. The loss of peripheral vision through the mask is of secondary importance to the need for protection from injuries. The design of the baseball mask and the positioning of the cross members is such that the wearer of the mask is given his primary visibility in the area directly forward of his eyes since he is primarily receiving throws from other players from a direction immediately in front of him.

Another example of a mask that is used in a sport, is a football mask. This type of mask is always attached to a football helmet and the number of cross members and their locations on the front of the mask are determined by the position that the player plays and the importance of his unrestricted visibility. If the player is a lineman, the primary importance of the mask is to prevent fingers, fist, elbows, etc. from reaching the players face. If the player is a pass receiver or back, the amount of protection provided for the player's face is reduced in order to maximize the player's visibility.

An additional example of a sport that uses a safety mask is fencing. Here the protection of the wearer's face is of maximum importance. Since the thickness of the object being protected against is very small in diameter, the fencer's mask has a grid network covering it formed from closely spaced wires running primarily in horizontal and vertical planes. The grid network is designed to prevent the penetration of the point of a rapier or like dueling instrument. The mask has no heavy cross members such as a baseball or football mask. Here the force of the object attempting to penetrate through the wearer's mask is small and the weight of the metal wires of the grid network can be kept relatively low. By virtue of the wire members being so closely spaced together, the visibility of the wearer is greatly reduced but in this sport it is acceptable for the wearer as long as he can make out the sihouette of his opponent.

In the past five years, the sport of racquetball has developed an ever increasing number of afficianados and novices. With this tremendous growth of the sport has also come numerous injuries. Most of these are either injuries to the eye resulting from the player turning around at the same time his opponent has smashed the ball forwardly in his direction or injuries to a player's teeth where his opponent's swing has made contact with more than just the ball. The game of racquetball is played with abandon and intensity by many players and there exists a need to protect the player's facial area.

It is an object of the invention to provide a novel racquetball or squash safety mask that will prevent the wearer from being struck in the eye by either the ball or the other player's racquet.

It is also an object of the invention to provide a novel racquetball or squash safety mask that will protect the wearer's teeth from damage due to an errant swing by an opponent.

It is a further object of the invention to provide a novel racquetball or squash safety mask that will protect the wearer from an errant swing of an opponent that might strike the wearer in the temple area.

It is an additional object of the invention to provide a novel racquetball or squash safety mask that will provide maximum protection from both a ball or racquet while providing maximum visibility for the wearer.

It is an additional object of the invention to provide a novel racquetball or squash safety mask having great protective strength while still being of only a minimal weight.

SUMMARY OF THE INVENTION

The racquetball or squash safety mask has a primary framework assembly, a secondary framework assembly, a grid network covering the secondary framework assembly, and a head strap assembly. The primary framework assembly has a top framework member, a bottom framework member and a pair of side framework members that function to form a base for the secondary framework assembly and also to support the safety mask on the wearer's face. The primary framework assembly is made of a light weight material such as aluminium rod and it is covered by a high impact plastic material. A temple guard member extends rearwardly from each of the side framework members. The temple guard may be in the form of a plastic shield in the form of a web member whose strength is re-enforced around its periphery by a portion of the primary framework assembly. The temple guard members function to protect the wearer from either his own or his opponent's errant swings with his racquet. A plurality of resilient pads are attached at spaced intervals to the primary framework assembly to cushion the safety mask against the wearer's face. These resilient pads are detachably attached to the primary framework assembly by Velcro fasteners.

The secondary framework assembly is attached to the primary framework assembly and it forms a convex frame that extends outwardly from the primary framework assembly. The secondary framework assembly has a central vertical strut member extending from the top framework member to the bottom framework member. It also has a plurality of intermediate strut members also extending between the top and bottom framework members with at least one such intermediate strut member in each of the zones between the central strut member and the respective side framework members. These intermediate strut members have a distinctive configuration or curvature in the zone immediately lateral to the wearer's eyes. The intermediate strut members have been designed to eliminate any vertical line that would interfere with the vision of the wearer into the corners of the court and also accomodate glasses worn by player. The secondary framework assembly also has a plurality of cross-members that link the central strut member to the intermediate strut members and the intermediate strut members in turn to the side framework members. A basic function of the secondary framework assembly is to provide a convex frame for the grid network that covers the secondary framework assembly. This grid network comprises a plurality of filaments that criss-cross each other with their ends secured to the primary framework assembly. The filaments are made of metal such as piano wire and are coated with a high impact plastic. The filaments of the grid network are laterally spaced apart a distance greater than one inch but less than two inches so that the grid network may prevent the passage of a racquetball or squash ball therethrough while at the same time maintaining maximum vision for the wearer. The filaments are also diagonally oriented with respect to the front of the mask such that none of the filaments lie in a vertical plane thereby minimizing the amount of impairment of the wearer's vision. A diagonal angle of 45° for the filaments appears to be the optimal orientation for the filaments.

Attached to the rear of the primary framework assembly is the head strap assembly. It has a top strap, a pair of intermediate yoke straps, and a pair of side straps that are fastened together at the back of the wearer's head by a buckle. The head strap assembly could also be replaced by a helmet thereby giving an increased protection for the back of the wearer's head. The helmet could also be of a light weight high impact plastic.

DESCRIPTION OF THE PREFERRED EMBODIMENT

Figure 1:
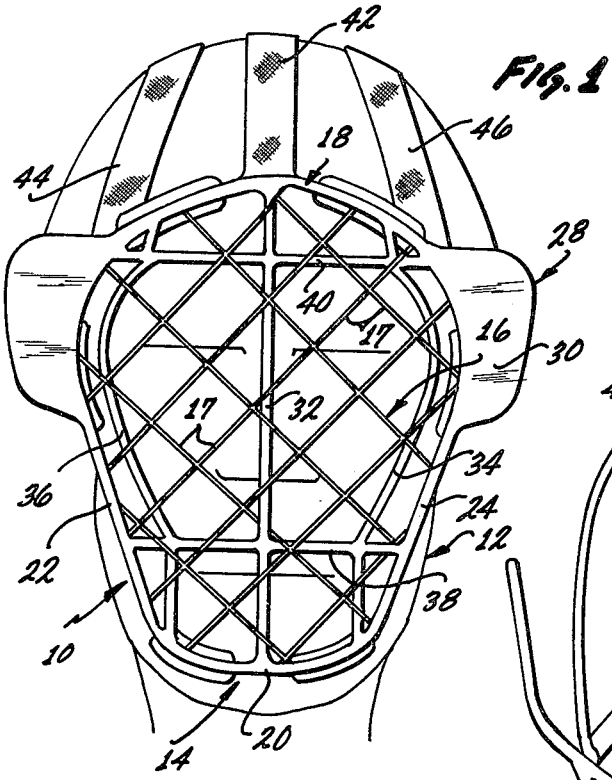
FIG. 1 is a front elevation view of the novel racquetball or squash safety mask on a player's head.
Figure 3:
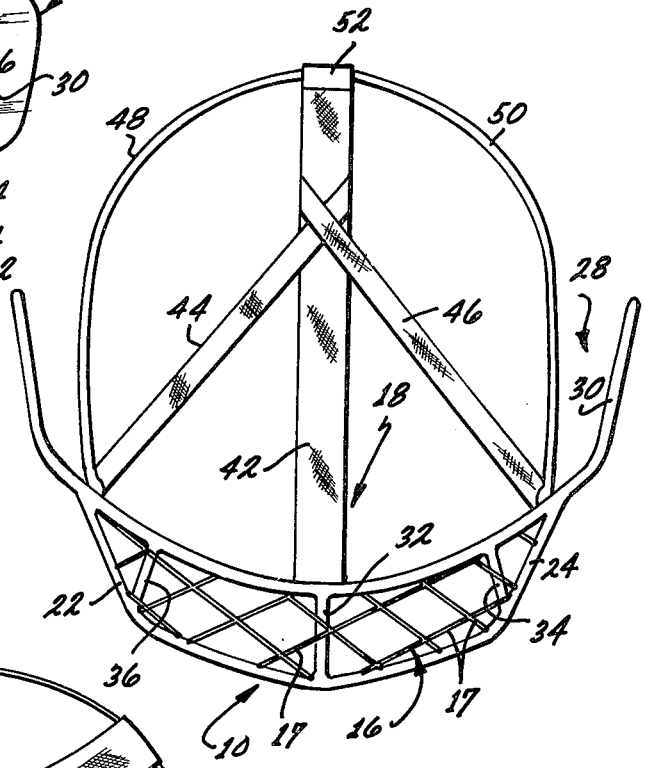
FIG. 3 is a top plan view of the novel racquetball or squash safety mask.
Figure 2:
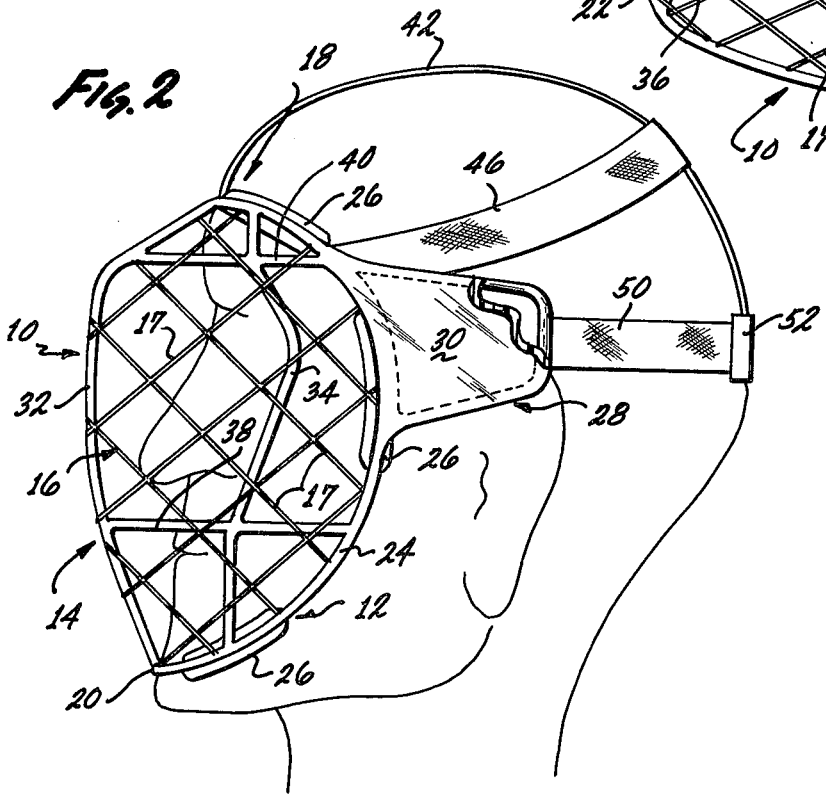
FIG. 2 is a side elevation view of the novel racquetball or squash safety mask on a player's head.

The novel racquetball or squash safety mask will be best described by referring to FIGS. 1–3 of the drawings. The safety mask is generally designated numeral 10. It has a primary framework assembly 12, a secondary framework assembly 14, a grid network 16, and a head strap assembly 18.

The primary framework assembly has a top framework member 18, a bottom framework member 20, and a pair of side framework members 22 and 24. A plurality of resilient pads 26 are attached at spaced intervals to the primary framework assembly. A temple guard member 28 extends rearwardly from each of the side framework members 22 and 24. The temple guard member has a web portion 30 that is stretched over and re-enforced by the side framework members.

The secondary framework assembly 14 has a central vertical strut member 32 and a pair of intermediate strut members 34 and 36, all of which extend from the top framework member 18 to the bottom framework member 20. Cross members 38 and 40 link the central strut member 32 to the intermediate strut members 34 and 36 and the intermedite strut members in turn to the side framework members 22 and 24.

The grid network 16 covers the secondary framework assembly 14 and comprises a plurality of filaments 17 that criss-cross each other and have their ends secured to the primary framework assembly 12.

The head strap assembly 18 has a top strap member 42, and a pair of intermediate yoke straps 44 and 46 secured thereto. A pair of side straps 48 and 50 extend rearwardly above the wearer's ears and are fastened together by buckle 52.

What is claimed is:

1. A racquetball or squash safety mask comprising: a primary framework assembly and a secondary framework assembly;

said primary framework assembly having a top framework member, a bottom framework member, and a pair of side framework members that function to form a base for the secondary framework assembly and also to support the safety mask upon the wearer's face:

said secondary framework assembly is attached to said primary framework assembly and it forms a convex frame that extends outwardly from said primary framework assembly and, a grid network covering said secondary framework assembly, said grid network comprising a plurality of filaments criss-crossing each other with their ends secured to said primary framework assembly, said filaments of said grid network being laterally spaced apart a distance greater than one inch but less than two inches, said filaments of said grid network being diagonally oriented with respect to the front of said mask such that none of the filaments lie in a vertical plane thereby minimizing the amount of impairment of the wearer's vision.

2. A racquetball or squash safety mask as recited in claim 1 further comprising a temple guard member extending rearwardly from each of said side framework members.

3. A racquetball or squash safety mask as recited in claim 1 wherein said primary framework assembly and said secondary framework assembly are made from lightweight metallic rod members.

4. A racquetball or squash safety mask as recited in claim 3 wherein said lightweight metallic rod members are coated with a high impact plastic material.

5. A racquetball or squash safety mask as recited in claim 1 further comprising a plurality of resilient pads attached at spaced intervals to said primary framework assembly to cushion said safety mask against the wearer's face.

6. A racquetball or squash safety mask as recited in claim 5 wherein said resilient pads are detachably attached to said primary framework assembly by Velcro fasteners.

7. A racquetball or squash safety mask as recited in claim 1 wherein said filaments are formed from piano wire and are coated with a high impact plastic.

* * * * *